US006499756B2

(12) United States Patent
Amirola

(10) Patent No.: US 6,499,756 B2
(45) Date of Patent: Dec. 31, 2002

(54) FOOTREST ASSEMBLY AND WHEELCHAIR THEREWITH

(75) Inventor: José Angel Otaola Amirola, Orduña (ES)

(73) Assignee: Sunrise Medical HHG Inc., Longmont, CO (US)

( * ) Notice: Subject to any disclaimer, the term of this patent is extended or adjusted under 35 U.S.C. 154(b) by 0 days.

(21) Appl. No.: 09/839,634

(22) Filed: Apr. 20, 2001

(65) Prior Publication Data

US 2002/0153697 A1 Oct. 24, 2002

(51) Int. Cl.[7] ..... B62M 1/14; A47C 1/02; A47C 20/00

(52) U.S. Cl. ..... 280/304.1; 280/250.1; 297/68; 297/423.37; 297/DIG. 4

(58) Field of Search ..... 280/304.1, 250.1; 297/423.19, 68, 423.26, 423.37, 69, DIG. 4

(56) References Cited

U.S. PATENT DOCUMENTS 4,790,553 A 12/1988 Okamoto
4,981,305 A * 1/1991 Lockard et al. ..... 297/DIG. 4
4,988,114 A * 1/1991 Thornton, Jr. et al. . 297/DIG. 4
5,542,690 A * 8/1996 Kozicki ..... 280/304.1

* cited by examiner

*Primary Examiner*—Avraham Lerner
*Assistant Examiner*—Matt Luby
(74) *Attorney, Agent, or Firm*—MacMillan, Sobanski & Todd, LLC

(57) ABSTRACT

A footrest assembly is comprised of an extension tube and a mounting assembly for mounting the extension tube to a wheelchair frame. The mounting assembly comprises means for pivotally mounting an upper end of the extension tube to the wheelchair frame. A support bracket extends from the extension tube. Coupling means is provided for releasably coupling the support bracket relative to the wheelchair frame in a first position. The coupling means includes means for enabling the support bracket to selectively rotate to a second position beside the wheelchair frame and to a third position beneath the wheelchair seat.

23 Claims, 6 Drawing Sheets

FOOTREST ASSEMBLY AND WHEELCHAIR THEREWITH

BACKGROUND OF THE INVENTION

This invention relates in general to wheelchairs and, in particular, to wheelchair accessories. Most particularly, the invention relates to a footrest for wheelchairs.

A constant effort is made to produce wheelchairs that are user friendly. Focus is drawn towards producing wheelchairs that are strong and durable yet portable and lightweight. Use of high-strength, lightweight, aircraft-grade aluminum tubing in wheelchair frames has led to the production of lightweight wheelchairs without sacrificing strength and durability. Advancements in folding frame construction have led to wheelchairs that are more portable. The use of seat slings and canvas backrests has further contributed to lightweight construction, and thus to the portability of wheelchairs. Various innovations have been directed towards adjustable features. Pivotal seat connections permit the seat to be adjusted in inclination and elevation. Recent developments in wheel mounting assemblies permit camber adjustments quickly and without the aid of tools. Even advancements in the construction of footrest assemblies have rendered such assemblies easily movable relative to the wheelchair frame. Often, such assemblies are also easily detachable. Most usually, the footrest assemblies pivot from a position in front of the chair to a position beside the wheelchair. When beside the wheelchair, the footrest assembly will not interfere with the user's ability to get into and out of the wheelchair. However, in this position, the footrest assembly could interfere with the ingress and egress of the wheelchair occupant in areas where a limited amount of space is available. To date, this problem has been addressed by removing the footrest assembly. Such footrest assemblies are often complex in construction and difficult to use, often demanding a great amount of dexterity from a wheelchair occupant. Consequently, this could be a cumbersome task for the wheelchair occupant.

What is needed is a simple, lightweight footrest assembly that is displaceable between a deployed position, a position beside the wheelchair side frame, and a position beneath the wheelchair seat readily and quickly, without the aid of tools.

SUMMARY OF THE INVENTION

The present invention is directed towards a footrest assembly that meets the foregoing needs. The footrest assembly is comprised of an extension tube and a mounting assembly for mounting the extension tube to a wheelchair frame. The mounting assembly comprises means for pivotally mounting an upper end of the extension tube to the wheelchair frame. A support bracket extends from the extension tube. Coupling means is provided for releasably coupling the support bracket relative to the wheelchair frame in a first position. The coupling means includes means for enabling the support bracket to selectively rotate to a second position beside the wheelchair frame and to a third position beneath the wheelchair seat.

In another embodiment of the invention, a footrest assembly is provided for a wheelchair having a side frame and a seat extending from the side frame. The side frame has a front tube. The foot tube has an upper end. An upwardly exposed opening is in the upper end. An upwardly facing shoulder is at the upper end. The assembly comprises an extension tube and a mounting assembly. The mounting assembly is structured to pivotally mount the footrest assembly for movement of about a substantially vertical axis relative to the front tube of the side frame of the wheelchair. The footrest assembly is further structured to be moved to a first position in front of the wheelchair, a second position beside the wheelchair, and a third position beneath the wheelchair seat.

In yet another embodiment of the invention, a wheelchair is provided comprising a side frame and a footrest assembly supported by the side frame. The side frame has a front tube with an upper end. An upwardly exposed opening is in the upper end and an upwardly facing shoulder is at the upper end. The footrest assembly comprises an extension tube and a mounting assembly. The mounting assembly comprises a pivotal joint, a support bracket and a latch assembly. The pivotal joint is supported by the upper end of the front tube. The support bracket extends from the extension tube. The support bracket is adapted to extend to the front tube at a position below the pivotal joint. The latch assembly is adapted to releasably latch the support bracket to the front tube so as to prevent pivotal movement of the footrest assembly.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
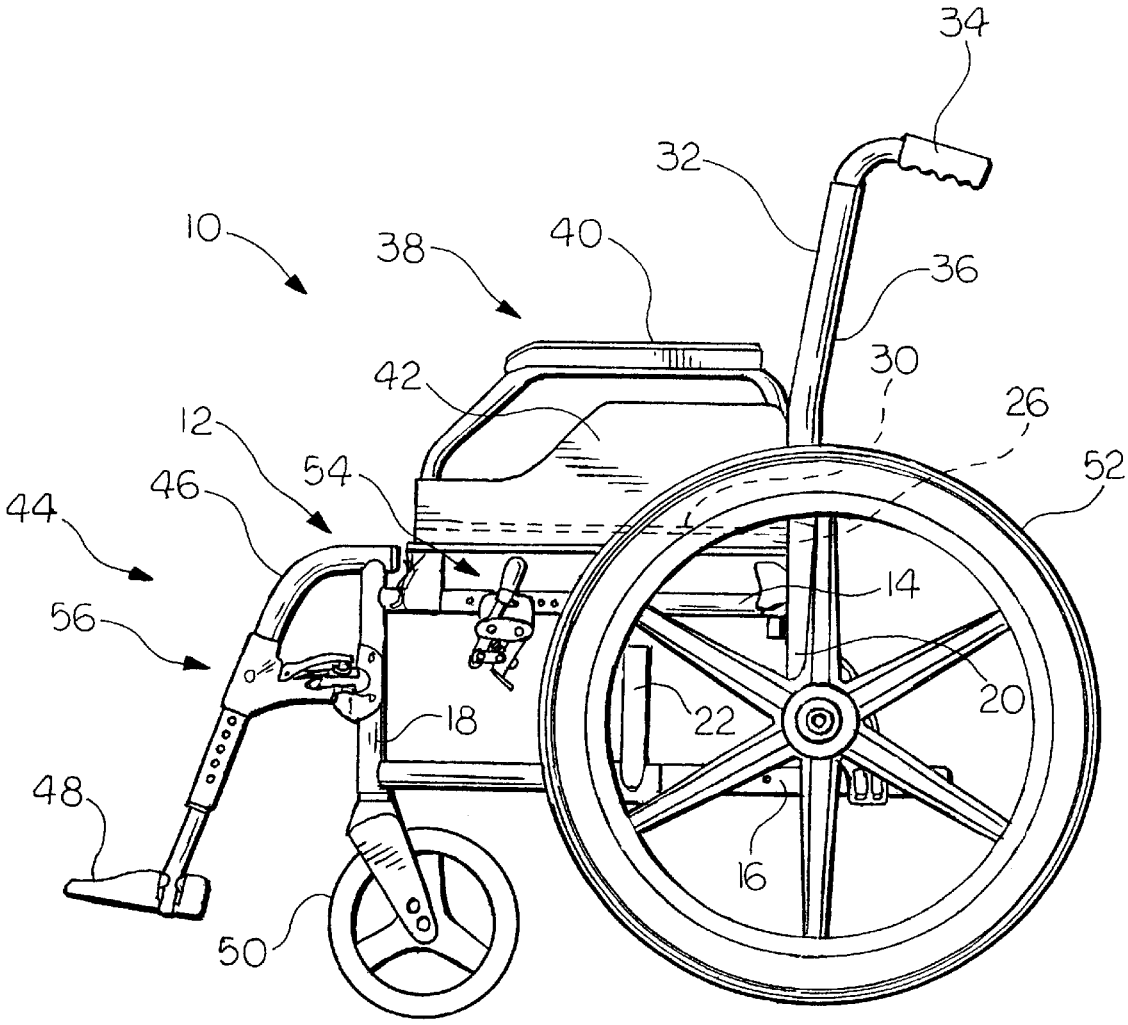
FIG. 1 is an elevational view of a wheelchair with a footrest assembly according to the present invention.

Referring now to the drawings, there is illustrated in FIG. 1 a wheelchair 10. The wheelchair 10 comprises a pair of spaced apart side frames 12. The side frames 12 each include an upper tube 14, a lower tube 16, a front tube 18, and a rear tube 20. These tubes are triangulated to form substantially rectangular shaped side frames.

The side frames 12 are joined together by cross tubes 22. Lower ends of the cross tubes 22 are pivotally connected to the lower tubes 16 of the side frames 12. Upper portions of the cross tubes 22 are movably connected relative to the upper tubes 14 by transverse braces (not shown). The cross tubes 22 are foldable to permit the wheelchair 10 to be folded into a compact form. The wheelchair 10 is foldable into a compact form to permit the wheelchair 10 to be easily transported and stored.

Upper ends of the cross tubes 22 are connected to seat tubes 26. The seat tubes 26 are adapted to be supported by upper tubes 14 of corresponding side frames 12. The upper tubes 14 can be provided with couplings, such as saddles (not shown), for supporting the seat tubes 26 relative to the upper tubes 14. A sling 30 extends substantially horizontally between the seat tubes 26. The sling 30 forms a seat for supporting a wheelchair occupant.

Seat back tubes 32 are inserted in the rear tubes 20 of the side frames 12. A canvas seat back 36 extends substantially vertically between the seat back tubes 32. The seat back 36 can be adjustable in elevation by raising and lowering the seat back tubes 32 relative to the rear tubes 20. Upper ends of the seat back tubes 32 can be provided with attendant handles 34 to aid an attendant in maneuvering the wheelchair 10.

As shown in the drawings, the upper tubes 14 can be adapted to support armrest assemblies 38. The armrest assemblies 38 can be comprised of armrest tubes (shown but not referenced) supporting armrests 40 and side guards 42. The armrests 40 are sufficiently low enough to permit a wheelchair occupant to gain access to rear drive wheels 52, which will be described herein below. The side guards 42 are provided to protect the wheelchair occupant's person or apparel from being caught in the spokes of the rear drive wheels 52.

Front casters 50 support the front end of the wheelchair 10 relative to a supporting surface. The front casters 50 can be affixed to the wheelchair 10 in any suitable manner. For example, the front casters 50 can be provided with stems (not shown) that are adapted to be inserted into lower open ends of the front tubes 18 of the side frames 12. Bearings (also not shown) can be provided in an annular space between the stems and front tubes 18. The stems are adapted to rotate in the front tubes 18 to enable the wheelchair 10 to be maneuvered.

Rear drive wheels 52 support the rear end of the wheelchair 10. The rear drive wheels 52 are adapted to be driven by the wheelchair occupant to propel and maneuver the wheelchair 10. The rear drive wheels 52 can be affixed to the wheelchair 10 in any suitable manner. For example, axle plates (not shown) can be affixed to the side frames 12. The axle plates can be provided with apertures for receiving axles or axle tubes, which, in turn, are adapted to receive axles. The axles rotatably support the rear drive wheels 52.

It can be desirable to lock the rear drive wheels 52 in a substantially fixed position to prevent the wheelchair 10 from moving. Locks, such as the wheel locks 54, can be provided for locking the rear drive wheels 52 in place. The wheel locks 54 can be attached to the side frames 12 adjacent the periphery of the rear drive wheels 52. The wheel locks 54 include levers and contact members (shown but not referenced). The levers are displaceable to a locked position wherein contact members are caused to engage the rear drive wheels 52. To unlock the rear drive wheels 52, the lever is displaceable to an unlocked position.

Extending from the front of the wheelchair 10 are footrest assemblies 44. The footrest assemblies 44 are comprised of extension tubes 46 and footplates 48. The extension tubes 46 extend forwardly and downwardly from the front tubes 18 of the side frames 12. The footplates 48 are attached to the lower ends of the extension tubes 46, preferably by a pivotal connection. Lateral leg supports (not shown) can also be supported by the extension tubes 46.

Figure 2:
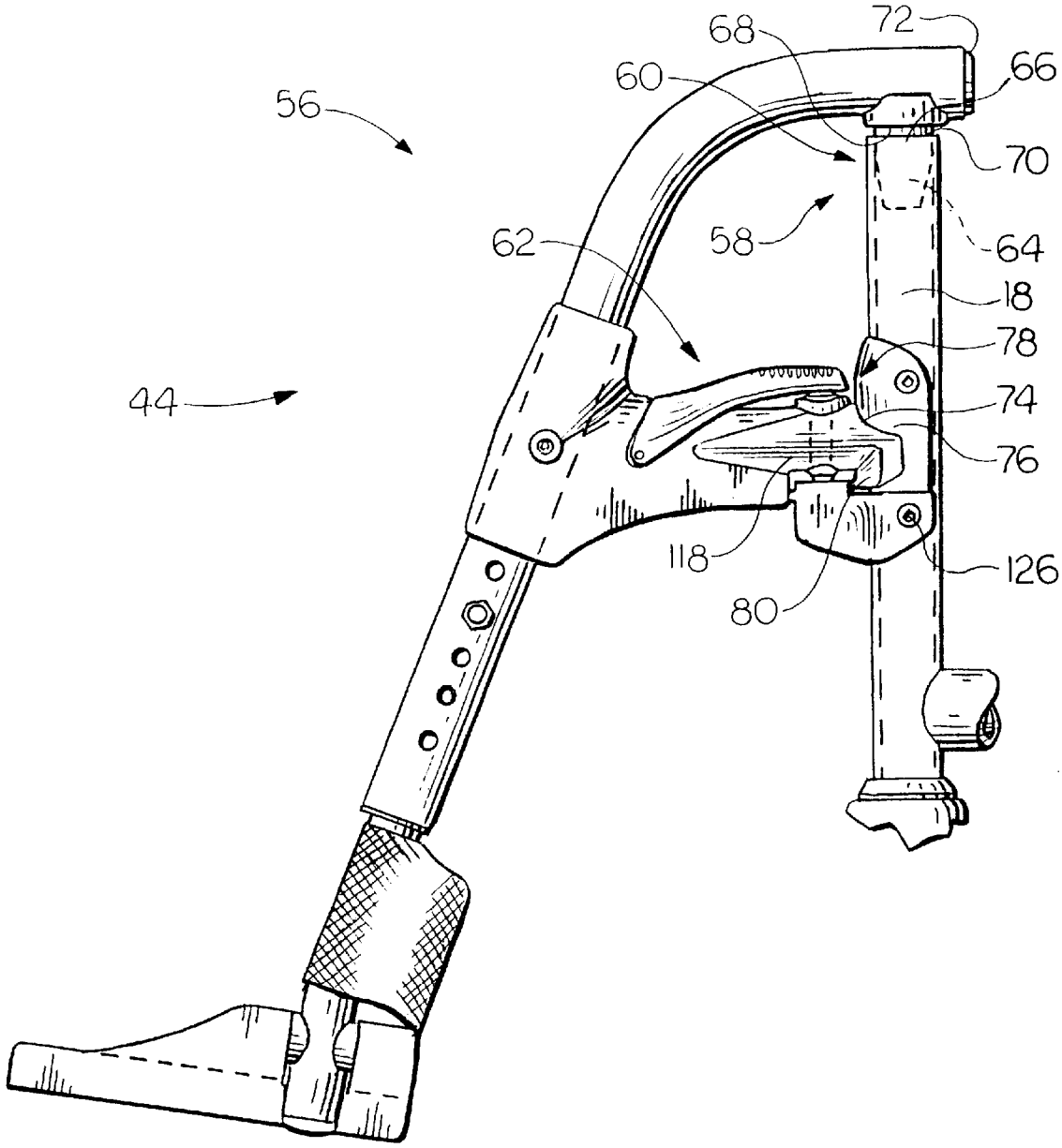
FIG. 2 is an enlarged side elevational view of the footrest assembly shown in FIG. 1 attached to a portion of the wheelchair side frame.
Figure 6:
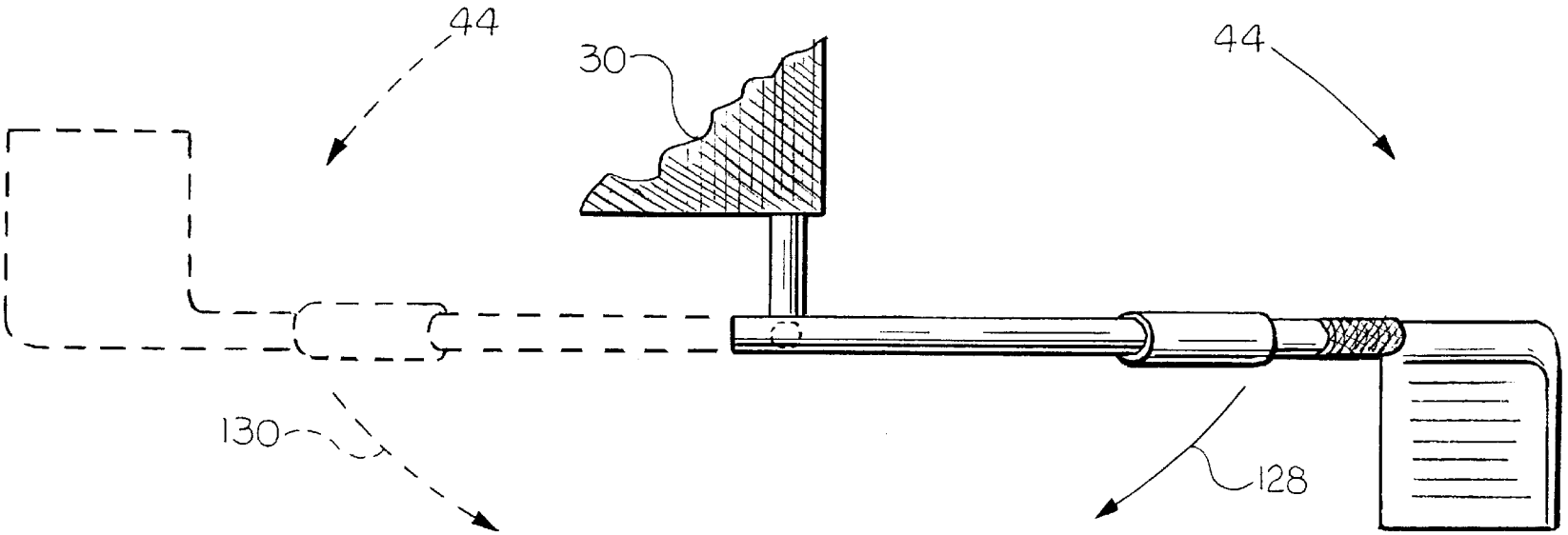
FIG. 6 is a top plane view of the footrest assembly shown in solid lines rotated to a second position beside the wheelchair side frame and in phantom lines rotated to a third position beneath the wheelchair seat sling.

In accordance with the present invention, a footrest mounting assembly 56 is provided. The mounting assembly 56 is pivotally mounted for movement of the footrest assemblies 44 about a substantially vertically oriented axis. As shown in FIGS. 1 and 2, the footrest assembly 44 can be moved to a first position in front of the wheelchair 10, where it is closely adjacent to front tube 18 and aligned with the side frame 12. In this position,. the footrest assembly 44 is deployed for use by a wheelchair occupant. When not in use, the footrest assembly 44 can be moved to a second position beside the wheelchair 10, as shown in solid lines in FIG. 6. In this position, the footrest assembly 44 is stored to provide the wheelchair occupant with increased access to and from the wheelchair 10. Alternatively, the footrest assembly 44 can be moved to a third position beneath the seat sling 30, as shown in phantom lines in FIG. 6. In this position, the front and side of the wheelchair 10 are exposed to assist the wheelchair occupant in getting in and out of the wheelchair 10. The footrest assembly 44 has a minimum number of components and it can be easily operated and manipulated by users with relatively limited manual dexterity.

Mounting of the footrest assembly 44 to the side frame 12 can be accomplished as follows. A pivotal joint 58 can be provided at the upper end 60 of front tube 18 of the side frame 12. A support bracket 62, which can be referred to as a first interlock assembly, can be provided below pivotal joint 58. The pivotal joint 58, as best seen in FIG. 2, can be affixed to the side frame 12 in any suitable manner. A downwardly depending pivotal lug 64 can be secured to the upper end of footrest extension tube 46. This can be accomplished with any suitable fastener (not shown). The lug 64 is adapted to be removably inserted into an upwardly exposed opening 66 at the upper end 60 of the front tube 18. The lug 64 can be seen to have a bearing surface or shoulder 68 which seats against an upwardly facing end or shoulder 70 of front tube 18. The lug 64 is telescoped inside of front tube 18 for pivotal movement with respect to the front tube 18. It is preferable that the lug 64 be formed of a material that has relatively low friction with respect to the front tube 18. Many plastics are suitable for this use. A cap 72 may be mounted in the upper end of the extension tube 46 to close the extension tube 46 against entry of water or debris therein. As constructed, pivotal joint 58 supports the load placed on the footrest assembly 44 by axially loading front tube 18 through abutting shoulders 68 and 70.

The footrest assembly 44 is subjected to considerable loading at various times. Accordingly, the pivotal joint 58 may not provide sufficient support on its own for some types of loads on the footrest assembly 44. In order to provide farther support and to better stabilize the footrest assembly 44, the footrest assembly 44 of the present invention includes a support bracket 62, as mentioned above. The support bracket 62 extends from the extension tube 46 of the footrest assembly 44 to the front tube 18 of the side frame 12 at a position below pivotal joint 58. The support bracket 62 includes an inner end, generally designated 74, which is formed to mate with and rotatably engage an abutment surface 76 supported by the front tube 18 of the side frame 12. Accordingly, the support bracket 62 of the present invention is detachably coupled to front tube 18.

The footrest assembly 44 of the present invention further includes a latch assembly, generally designated 78. The latch assembly 78, which can be referred to as a second interlock assembly, is positioned forwardly of the abutment surface 76 and adapted to releasably latch the support bracket 62 against pivotal movement from the first position in front of the wheelchair 10. The latch assembly 78 further secures inner end 74 of the support bracket 62 in tight abutting relation against the abutment surface 76 when the footrest assembly 44 is in the first position to rigidly support the footrest assembly 44. It is particularly important in lightweight wheelchairs for moveable components to be latched in a position that feels rigid and secure to the wheelchair occupant. Accordingly, the footrest assembly 44 should not be loose or wobble when it is latched in a forward or first position.

Figure 3:
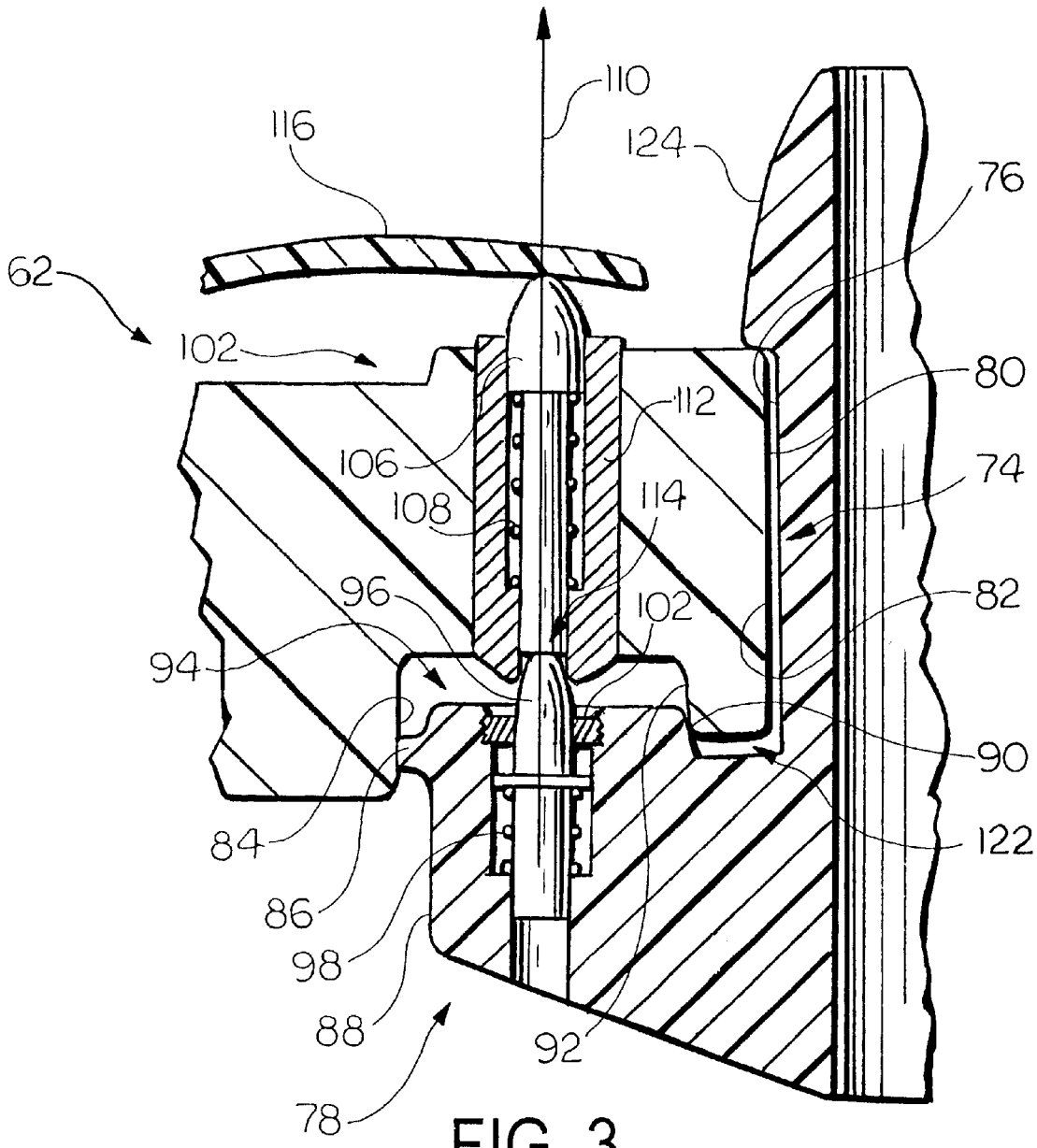
FIG. 3 is a sectional view of a footrest mounting assembly according to the present invention in a locked position.
Figure 4:
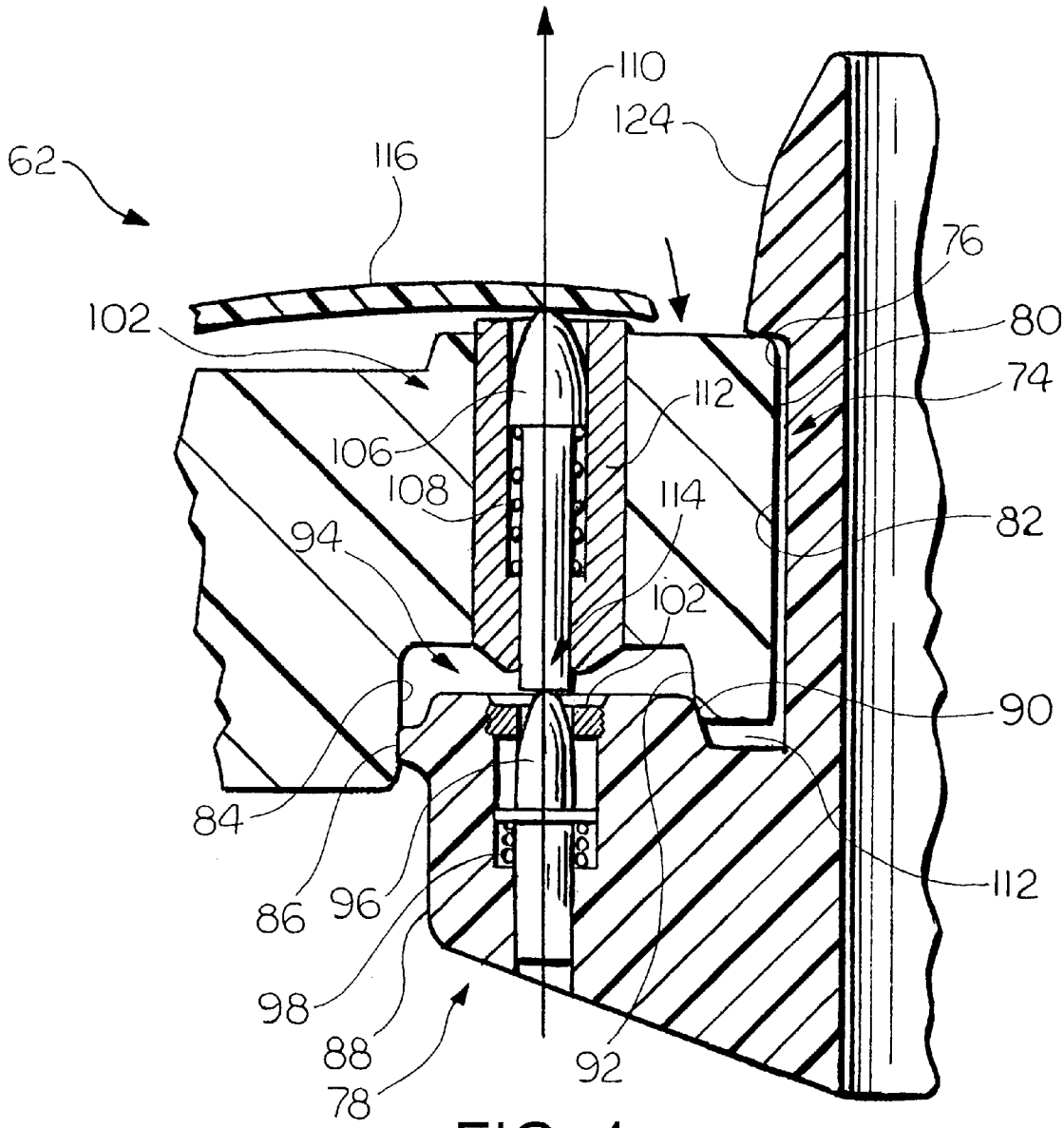
FIG. 4 is a sectional view of a footrest mounting assembly according to the present invention in an unlocked position.
Figure 5:
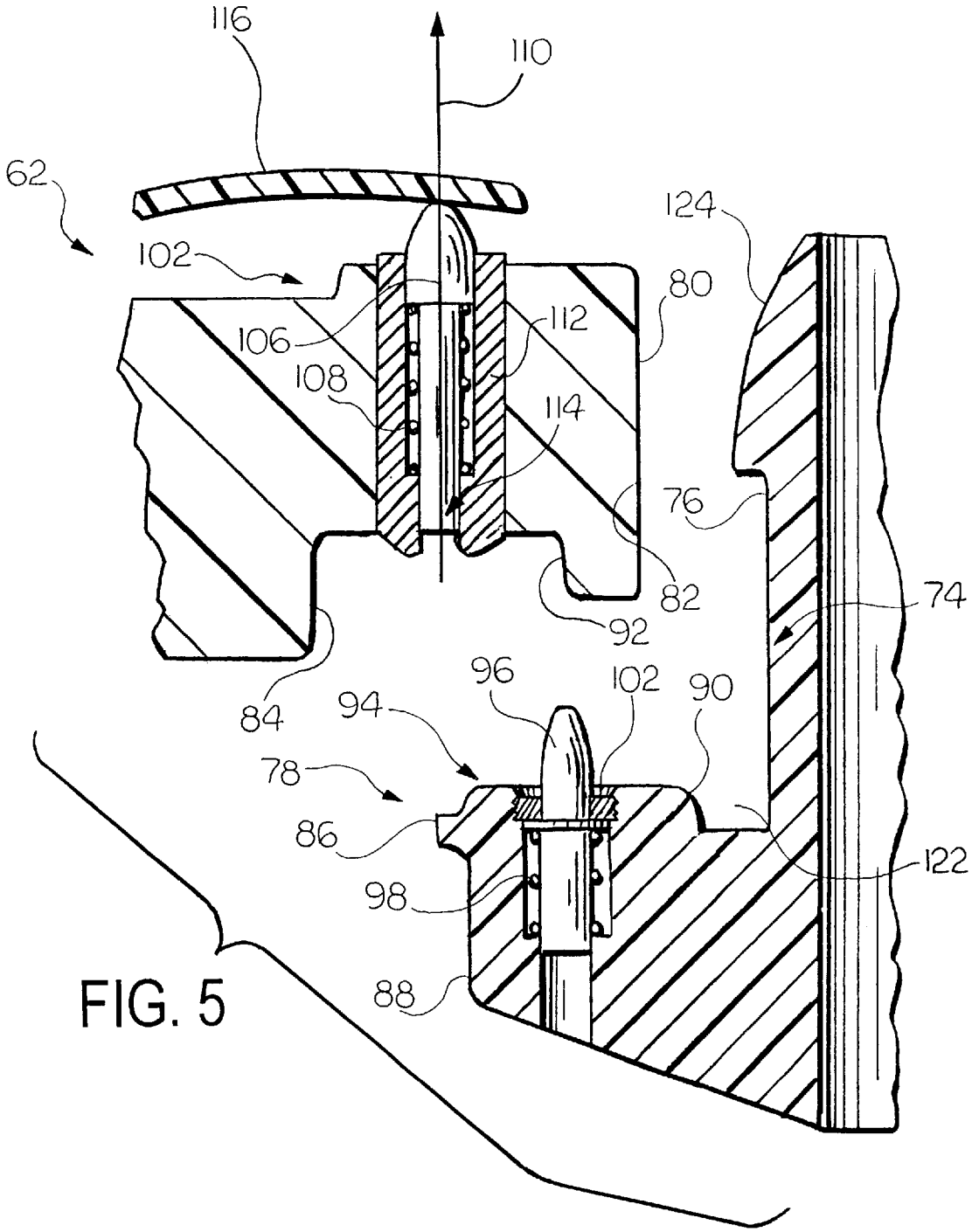
FIG. 5 is a sectional view of a footrest mounting assembly according to the present invention, with a support bracket and latch assembly thereof disengaged.

The details of construction of latch assembly 78 can best be understood by referring to FIGS. 3, 4, and 5. The inner end 74 of support bracket 62 has a generally C-shaped saddle 80 (shown in FIG. 2), which extends axially in a substantially vertical direction. The abutment surface 76 has a cylindrical surface 82 which mates with the saddle 80 at the inner end 74 of the support bracket 62. The support bracket 62 also has a vertically extending shelf member 84, which is in spaced relation to the inner end 74 of the support bracket 62. The shelf member 84 is adapted to engage a nodule 86 projecting from a forwardly exposed surface 88 of the latch assembly 78. The latch assembly 78 also has a vertically extending shelf member 90 in a spaced relation to the forwardly exposed surface 88 of the latch assembly 78. A forwardly exposed surface 92 of the saddle 80 is adapted to engage the shelf member 90 of the latch assembly 78. Together the saddle 80, the shelf member 84 of the support bracket 62, and the forwardly exposed surface 92 of the saddle 80 slidably engage and pivot about the abutment surface 76, the shelf member 90, and the forwardly exposed surface 88. When the footrest assembly 44 is rotated in the first position, the shelf member 84 tightly engages the nodule 86 so that the footrest assembly 44 should not be loose or wobble. A housing, generally indicated at 94, is defined between the forwardly exposed surface 88 and the shelf member 90 of the latch assembly 78. The housing 94 carries a vertically extending latch pin 96. The latch pin 96 and front tube 18 of the side frame 12 are in a generally parallel spaced apart relation. The latch pin 96 preferably has an enlarged diameter head and a reduced diameter portion. The reduced diameter portion carries a helical spring 98. The spring 98 is compressed in the housing 94 so that it acts upon the latch pin 96 to urge the latch pin 96 upwardly in the direction indicated by arrow 110. The housing 94 also carries a keeper 100. The keeper 100 prevents the latch pin 96 from escaping from the housing 94. The housing 94 can be formed of a lightweight plastic or metal material, but the latch pin 96 and the keeper 100 are preferably steel.

The inner end 74 of the support bracket 62 also defines a housing, generally indicated at 102. The housing 102 carries a vertically extending release pin 106. The release pin 106 preferably has an enlarged head and a reduced diameter portion. The reduced diameter portion supports a helical spring 108. The release pin 106 is biased by the spring 108 to urge the release pin 106 upwardly in the direction indicated by arrow 110. A sleeve 112 is preferably mounted in the housing 102 about the release pin 106. The latch pin 96 is adapted to engage a downwardly exposed opening 114 defined by the sleeve 112. The latch pin 96 is adapted to engage the opening 114 when the footrest assembly 44 is rotated in the first position. This occurs automatically due to the force of the spring 98 acting on the latch pin 96. The footrest assembly 44 is deployed for use by rotating the inner end 74 of the support bracket 62 relative to the abutment surface 76. To achieve a smooth rotation, opposing sides of the support bracket 62 are provided with ramped approached surfaces 118 (shown in FIG. 2). As the latch pin 96 engages and traverses an approached surface 118, the latch pin 96 is depressed against the force of the spring 98. When the latch pin 96 reaches the sleeve 112, it is biased by the spring 98 into engagement with the sleeve 112. To disengage the latch pin 96 from the sleeve 112, depress the release pin 106 downwardly against the latch pin 96 and against the forces of the springs 98, 108. In a preferred embodiment of the invention, a lever 116 is pivotally attached to the support bracket 62 forwardly of the housing 102. A free end of the lever 116 extends rearward from the point of attachment and is cantilevered over the release pin 106. The lever 116, therefore, is provided to aid in depressing the release pin 106. Moreover, the lever 116 functions as a keeper to prevent the release pin 106 from popping up and out of the sleeve 112. Accordingly, the free end of the lever 116 is biased upwardly from the housing 102 by the release pin 106. In accordance with a preferred embodiment of the invention, the support bracket 62, the release pin 106, and the lever 116 can be molded from plastic but the sleeve is preferably a metal sleeve.

An arcuate shaped channel 122 is defined between the abutment surface 76 and the shelf member 90 of the latch assembly 78. The channel 122 is adapted to receive a lower end of the saddle 80 when rotating the inner end 74 relative to the abutment surface 76. An outwardly protruding upper stop member 124 is in a spaced relation to the channel 122. The saddle 80 is trapped between the channel 122 and the stop member 124 when the footrest assembly 44 has been rotated to the first position. Accordingly, the inner end 74 of the support bracket 62 is trapped between the channel 122 and the stop member 124. Trapping the inner end 74 of the support bracket 62 between the stop member 124 and upper tube 14 prevents the footrest assembly 44 from being removed unless the footrest assembly 44 is rotated to either of the second or third positions.

The lower end of the saddle 80 and the channel 122 are constructed so that the inner end 74 of the support bracket 62 will be bound against the abutment surface 76 when rotating the support bracket 62 to the first position. The latch assembly 78 is preferably secured to the front tube 18 of the side frame 12 by rivets 126. The saddle 80 mates with tubular front tube 18 of the side frame 12 to increase the contact surface area and decrease the stress concentration between the inner end 74 of the support bracket 62 and the front tube 18.

Operation of the support bracket 62 and the latch assembly 78 now can be described. The lug 64 at the upper end of the footrest extension tube 46 is inserted into the upwardly exposed opening 66 at the upper end 60 of the front tube 18. Subsequently, the support bracket 62 is rotated in the direction of arrows 128, 130. As support bracket 62 is rotated, the bottom of the saddle 80 at the inner end 74 of the support bracket 62 will enter the channel 122 defined between the abutment surface 76 and the shelf member 90 of the latch assembly 78. The saddle 80 will engage the abutment surface 76 of the latch assembly 78. The latch pin 96 will engage the approached surface 118. As the latch pin 96 traverses the approached surface 118, the latch pin 96 will be displaced against biasing spring 98 in a direction opposed to arrow 110. As rotation of support bracket 62 is continued, latch pin 96 begins to engage the downwardly exposed opening 114 defined by the sleeve 112. As the bracket is completely rotated to the first position, the spring 98 urges the latch pin 96 in the direction of arrow 110 so that latch pin 96 snaps into the sleeve 112 to resist further movement of the footrest assembly 44. This task is relatively simple for even those users who have limited manual dexterity. There are no buttons to push or openings and pins to align.

Release of the latch assembly also is simply accomplished by depressing the lever 116 in a downward direction opposite to the direction indicated by the arrow 110. This urges the release pin 106 downward into contact with the latch pin 96. This urges the latch pin 96 out of the sleeve 112 to permit the footrest assembly 44 to be rotated in either direction opposite to the directions indicated by arrows 128, 130.

Detachment of the footrest assembly 44 can also be easily accomplished. When the saddle 80 is aligned with the stop member 124, the stop member 124 prevents lifting of the latch assembly 44. Once the footrest assembly 44 is rotated to the second or third positions, the saddle 80 can be seen to be clear of the stop member 124 and the entire footrest assembly 44 can be lifted vertically. The lug 64 will lift out of the upper end 60 of the front tube 18 and the inner end 74 of the support bracket 62, which carries the saddle 80, will lift up past the stop member 124, which no longer engages the saddle 80. Again, this only requires release of the latch pin 96 by depressing the lever 116, rotation of support bracket 62 towards the second position or third positions, and lifting of the entire footrest assembly 44, all tasks which require limited manual dexterity. Thus, the latch assembly 44 is formed for tool-free detachment from the wheelchair 10 once it has been rotated to a position beside the side frame 12 or beneath the seat sling 30.

It is an important feature of the present invention that the approached surface 118 be formed as a ramp surface so that rotation of the footrest assembly 44 will be smooth as the latch pin 96 traverses the footrest assembly 44.

It is another important feature of the present invention that the stop member 124 extend over the upper end of the saddle 80 to trap the saddle between the channel 122 and the stop member 124, thus preventing the footrest assembly 44 from being disengaged from the front tube 18 of the side frame 12 unless the footrest assembly 44 is rotated to the second or third positions.

In accordance with the provisions of the patent statutes, the principle and mode of operation of this invention have been explained and illustrated in its preferred embodiment. However, it must be understood that this invention can be practiced otherwise than as specifically explained and illustrated without departing from its spirit or scope.

What is claimed is:

1. A footrest assembly for a wheelchair having a frame and a seat, said assembly comprising:

an extension tube; and a mounting assembly for mounting said extension tube to a wheelchair frame, said mounting assembly comprising:

means for pivotally mounting an upper end of said extension tube to the wheelchair frame;

a support bracket extending from said extension tube; and means for releasably coupling said support bracket relative to said wheelchair frame in a first position, said coupling means including means for enabling said support bracket to selectively rotate to a second position beside the wheelchair frame and to a third position beneath the wheelchair seat.

2. A footrest assembly for a wheelchair having a side frame and a seat extending from the side frame, the side frame having a front tube with an upper end and an upwardly exposed opening in the upper end and an upwardly facing shoulder at the upper end, the assembly comprising:

an extension tube; and a mounting assembly structured to pivotally mount said footrest assembly for movement of about a substantially vertical axis relative to the front tube of the side frame of the wheelchair, said footrest assembly further being structured to be moved to a first position in front of the wheelchair, a second position beside the wheelchair, and a third position beneath the wheelchair seat.

3. The footrest assembly according to claim 2, further comprising a footplate, said extension tube having a lower end, said footplate being attached to said lower end of said extension tube.

4. The footrest assembly according to claim 2, wherein said mounting assembly comprises a pivotal joint structured to be supported by the upper end of the front tube of the side frame.

5. The footrest assembly according to claim 4, wherein said extension tube has an upper end and said pivotal joint comprises a pivotal lug depending downwardly from an upper end of said extension tube, said lug being adapted to be removably inserted into the upwardly exposed opening at the upper end of the front tube of the side frame of the wheelchair.

6. The footrest assembly according to claim 5, wherein said lug has a bearing shoulder which is adapted to seat against the upwardly facing shoulder of the front tube of the side frame of the wheelchair.

7. The footrest assembly according to claim 4, wherein said footrest assembly further comprises a support bracket extending from said extension tube, said support bracket being adapted to extend to the front tube of the side frame of the wheelchair at a position below said pivotal joint.

8. The footrest assembly according to claim 7, wherein said support bracket is structured to be detachably coupled to the front tube of the side frame of the wheelchair.

9. The footrest assembly according to claim 7, wherein said support bracket includes an inner end that is formed to mate with and rotatably engage an abutment surface that is adapted to be supported by the front tube of the side frame of the wheelchair.

10. The footrest assembly according to claim 9, further comprising a latch assembly positioned forwardly of said abutment surface and adapted to releasably latch said support bracket against pivotal movement when said footrest assembly is in the first position.

11. The footrest assembly according to claim 10, wherein said inner end of said support bracket has a generally C-shaped saddle which extends axially in a substantially vertical direction and said abutment surface has a cylindrical surface which mates with said saddle.

12. The footrest assembly according to claim 10, wherein said support bracket further has a vertically extending shelf member which is in spaced relation to said inner end, said shelf member being adapted to engage a nodule projecting from a forwardly exposed surface of said latch assembly.

13. The footrest assembly according to claim 10, wherein said latch assembly has a vertically extending shelf member in a spaced relation to a forwardly exposed surface of said latch assembly, said saddle having a forwardly exposed surface that is adapted to engage said shelf member of said latch assembly.

14. The footrest assembly according to claim 10, wherein said latch assembly comprises a housing carrying a latch pin, said latch pin and the front tube of the side frame are adapted to be in generally parallel spaced apart relation.

15. A footrest assembly for a wheelchair having a side frame and a seat supported by the side frame, the side frame having a front tube, the assembly comprising:

an extension tube;

a mounting assembly structured to pivotally mount said footrest assembly relative to the front tube at a pivot joint;

a support bracket extending from said extension tube, said support bracket being adapted to extend to the front tube of the side frame of the wheelchair at a position below said pivotal joint, said support bracket including an inner end that is formed to mate with and rotatably engage an abutment surface that is adapted to be supported by the front tube; and a latch assembly positioned forwardly of said abutment surface and adapted to releasably latch said support bracket against pivotal movement, said latch assembly defining an arcuate shaped channel adjacent said abutment surface and said inner end of said support bracket having a saddle, said channel being adapted to receive a lower end of said saddle when rotating said inner end relative to said abutment surface.

16. The footrest assembly according to claim 15, wherein an outwardly protruding upper stop member is in a spaced relation to said channel, said saddle being adapted to be trapped between said channel and said stop member when said footrest assembly is rotated to the first position.

17. The footrest assembly according to claim 16, wherein said inner end of said support bracket is trapped between said channel and said stop member.

18. A footrest assembly for a wheelchair having a side frame and a seat supported by the side frame, the side frame having a front tube, the assembly comprising:

an extension tube; and a mounting assembly structured to pivotally mount relative to the front tube at a pivot joint;

a support bracket extending from said extension tube, said support bracket being adapted to extend to the front tube at a position below said pivotal joint, said support bracket including an inner end that is formed to mate with and rotatably engage an abutment surface that is adapted to be supported by the front tube; and a latch assembly positioned forwardly of said abutment surface, said latch assembly comprising a housing carrying a latch pin, said latch pin carrying a spring, said spring being compressed in said housing so that said spring acts upon said latch pin to urge said latch pin upwardly into engagement with said support bracket.

19. The footrest assembly according to claim 18, wherein said inner end of said support bracket defines a housing that carries a vertically extending release pin, said release pin supporting a spring for urging said release pin upwardly.

20. The footrest assembly according to claim 19, further comprising a lever pivotally attached to said support bracket forwardly of said housing of said support bracket, said lever having a free end extending rearward and being cantilevered over said release pin, said free end being biased upwardly from said housing of said support bracket by said release pin, said lever being provided to aid in depressing said release pin.

21. The footrest assembly according to claim 20, wherein said lever is structured to prevent said release pin from popping up and out of said housing of said support bracket.

22. The footrest assembly according to claim 18, wherein said latch pin is adapted to engage a downwardly exposed opening in said support bracket when the footrest assembly is rotated to the first position due to said spring acting on said latch pin.

23. The footrest assembly according to claim 18, wherein said support bracket is provided with opposing sides having approached surfaces, said latch pin being adapted to engage and traverse said approached surfaces to depress said latch pin.

* * * * *